United States Patent [19]

Kunz

[11] Patent Number: 5,013,268

[45] Date of Patent: May 7, 1991

[54] DEVICE FOR CONNECTING A HEATING WIRE TO A CURRENT CONDUCTOR TERMINAL

[75] Inventor: Anton Kunz, Triesenberg, Liechtenstein

[73] Assignee: Balzers Aktiengesellschaft, Balzers, Liechtenstein

[21] Appl. No.: 463,373

[22] Filed: Jan. 11, 1990

[30] Foreign Application Priority Data

Feb. 10, 1989 [CH] Switzerland ..... 489/89

[51] Int. Cl.[5] ..... H01R 4/50

[52] U.S. Cl. ..... 439/807

[58] Field of Search ..... 439/727, 807, 811, 815

[56] References Cited

FOREIGN PATENT DOCUMENTS 615700 7/1935 Fed. Rep. of Germany ..... 439/807
821473 12/1937 France ..... 439/807
403131 11/1945 Italy ..... 439/807

*Primary Examiner*—Eugene F. Desmond
*Attorney, Agent, or Firm*—Notaro & Michalos

[57] ABSTRACT

In order to make a connection between a heating wire for the production of a stream of ions and a current conductor terminal the heating wire which is enclosed by a shoe into an axial bore at the end of the current conductor and is clampingly held by a clamping member in form of a sphere pressed against the shoe, whereby a tapered section of the screw bolt is pressed the sphere, said screw bolt being screwed into a tapped hole in the current conductor terminal which extends parallel to the hole in which said shoe is received.

3 Claims, 1 Drawing Sheet

FIG. 1
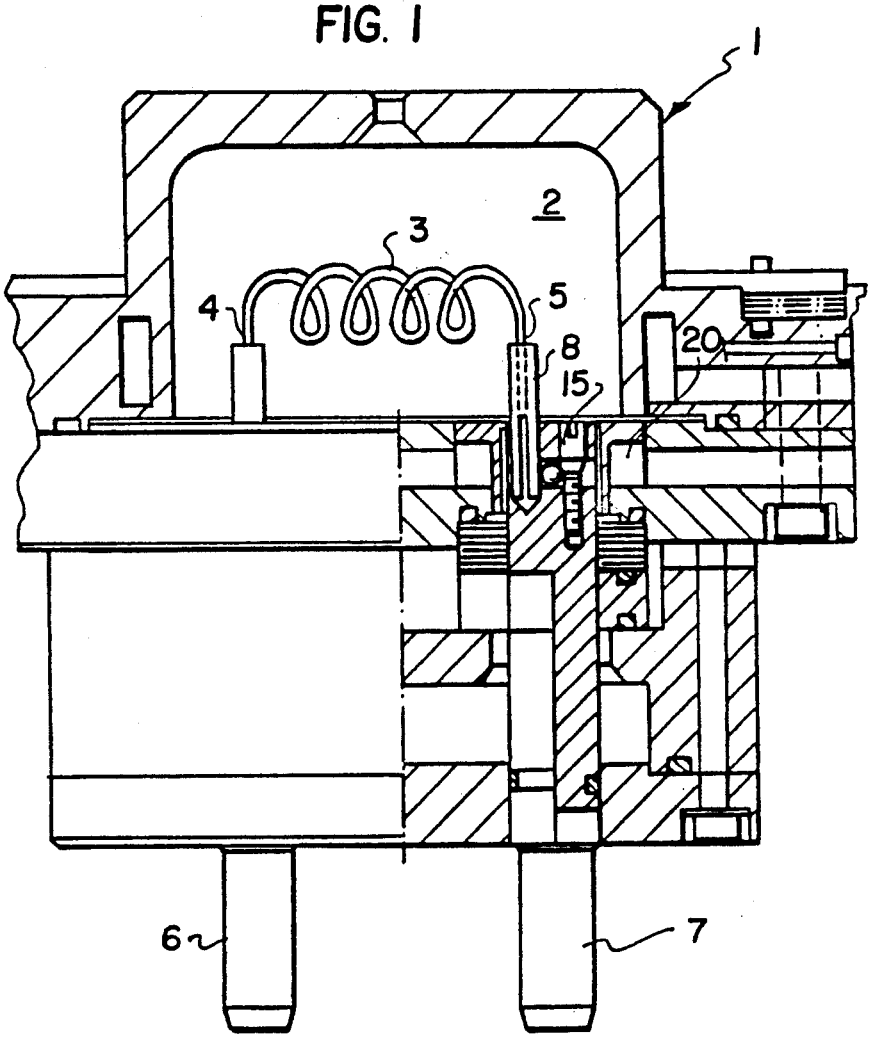
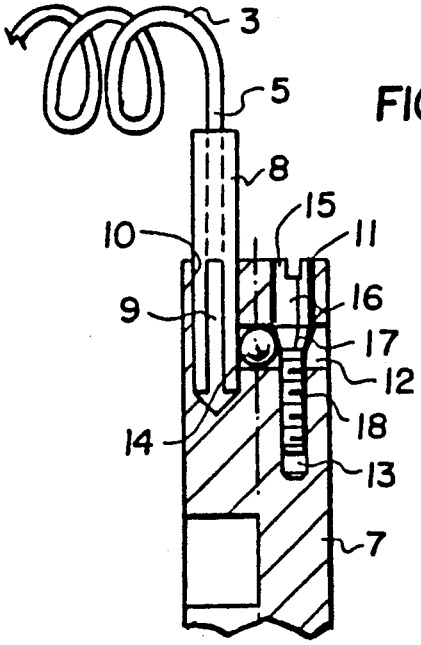
FIG. 2

DEVICE FOR CONNECTING A HEATING WIRE TO A CURRENT CONDUCTOR TERMINAL

BACKGROUND OF THE INVENTION

1. Field of the Invention

The present invention relates to a device for connecting a heating wire intended for generating a stream of ions to respective current conductor terminals.

2. Description of the Prior Art

If, for instance, in a vacuum deposition apparatus a stream of ions up to 300 amperes is generated an extremely high temperature of about 2000° C. is encountered.

The hitherto common mounting techniques by means of a clamping screw are no longer reliable at such high temperatures if the screw bolt and the tapped hole are located in the highly heated area. Also other mounting techniques which have been proposed, such as a cone clamping device, which loosens at a heating thereof, are not suitable regarding a preventing of the connection from becoming useless after a certain time or a preventing of faults of the passage of the current.

SUMMARY OF THE INVENTION

Hence, it is a general object of the present invention to provide a construction in which the screw bolt used for the clamping is located somewhat further distant from the heated zone and at a location where it can be cooled better and, moreover, to concentrate the clamping force which can be generated by the screw bolt at at small area.

A further object is to provide a construction which includes an axial bore at the end of a respective current conductor terminal in which a rectilinear end section of the heating wire is received and including further a tapped hole extending parallel to the axial bore and a screw bolt having a tapered section threaded thereinto and a recess located between the axial bore and the tapped hole in the current conductor terminal in which a clamping member is located urged by the tapered section of the screw bolt upon its tightening against the rectilinear end section of the heating wire.

Yet a further object is to provide a device of which the clamping member has a spherical shape and is pressed against a shoe encasing the end of the heating wire. Such guarantees an impeccable transfer of the eletrical current.

BRIEF DESCRIPTION OF THE DRAWINGS

The invention will be better understood and objects other than those set forth above will become apparent when consideration is given to the following detailed description thereof. Such description makes reference to the annexed drawings, wherein:

FIG. 1 illustrates a vertical section through a part of an apparatus for generating by means of a heating wire, a stream of ions; and FIG. 2 illustrates on a somewhat enlarged scale the connection of the heating wire to a current conductor terminal shown in FIG. 1.

DESCRIPTION OF THE PREFERRED EMBODIMENT

The apparatus 1 illustrated in FIG. 1 comprises a separated chamber 2 in which an ion source 3 in form of a helix is located by means of which a stream of ions up to 300 amperes is generated. The heating wire 3 which forms the source of ions includes two rectilinear end sections 3 and 4. These are now to be mounted to respective current conductor terminals 6 and 7. The mounting or connecting thereof to a respective end of the heating wire 3 is designed identically at either end and is accordingly illustrated only once in FIG. 1 and in detail on a larger scale in FIG. 2.

The rectilinear end section 5 of the heating wire 3 is enclosed by a shoe 8 of which the lower end includes a longitudinal slot 9. The current conductor terminal 7 has an excentrically located axial bore 10 into which projects said shoe 8 including the rectilinear heating coil end section 5 located therewithin. A further bore 11 extends parallel to the bore 10 into the current conductor terminal 7 which further bore 11 opens at a distance from the upper end into a lateral bore 12 and which in a rectilinear continuation of the bore 11 is designed below the lateral bore 12 as a tapped hole of a smaller diameter. A clamping member 14 having a spherical shape is located in the lateral bore 12 which extends upto the bore 10 in which the shoe 8 is received, which spherical clamping member abuts the shoe 8. A screw bolt comprises an upper cylindrical section 16 which is located in said bore 11 and a tapered section 17 following the cylindrical section 16 and followed in turn by a threaded section 18 by means of which the screw bolt 15 is screwed into the tapped hole 13 such that upon a tightening of the screw bolt the tapered section 17 of the screw is pressed against the sphere 14 which in turn is pressed against the shoe 8. When tightening the screw a large clamping force is produced and the screw is thereby supported in the bore 11 below the sphere in the tapped hole 13 and thereabove in the cylindrical section 11.

According to FIG. 1 the screw bolt 15 is located close to a channel 20 formed in the apparatus which contains a cooling medium such that the clamping action is also maintained at a high heating.

While there is shown and described a present preferred embodiment of the invention it is to be distinctly understood that the invention in not limited thereto, but may be otherwise variously embodied and practiced within the scope of the following claims.

I claim:

1. A device for connecting a heating wire intended for generating a stream of ions to respective current conductor terminals, comprising:

an axial bore at the end of a respective current conductor terminal in which a rectilinear end section of said heating wire is received, comprising further a tapped hole extending parallel to said axial bore and a screw bolt having a tapered section threaded thereinto and a recess located between said axial bore and said tapped hole in said current conductor terminal in which a clamping member is located, said clamping member being urged by said tapered section of said screw bolt upon its tightening against said rectilinear end section of said heating wire, the respective end section of the heating wire being enclosed by a shoe having longitudinal slot at the clamped area, against which shoe said clamping member is pressed.

2. The device of claim 1 in which said clamping member has a spherical shape.

3. The device of claim 1 in which said tapered section of said screw bolt is located between a lower threaded section and an upper cylindrical section thereof and is supported below as well as above said clamping member at the opposite side thereof within said current conductor terminal.

* * * * *